US005192160A

United States Patent [19]

Muehlstaedter

[11] Patent Number: 5,192,160

[45] Date of Patent: Mar. 9, 1993

[54] METHOD AND APPARATUS FOR MAKING MANHOLES

[76] Inventor: Alexander Muehlstaedter, Gartenstr. 7, D-6749 Birkenhoerdt-Bad Bergzabern, Fed. Rep. of Germany

[21] Appl. No.: 585,113

[22] PCT Filed: Mar. 31, 1989

[86] PCT No.: PCT/EP89/00361

§ 371 Date: Dec. 19, 1991

§ 102(e) Date: Dec. 19, 1991

[87] PCT Pub. No.: WO89/09307

PCT Pub. Date: Oct. 5, 1989

[30] Foreign Application Priority Data

Mar. 31, 1988 [DE] Fed. Rep. of Germany ..... 3810933

[51] Int. Cl.[5] ..... E01C 23/06; E01C 23/09; E01C 23/12

[52] U.S. Cl. ..... 404/72; 299/37; 299/39; 404/90

[58] Field of Search ..... 299/15, 37, 38, 39, 299/69; 404/72, 75, 89, 90

[56] References Cited

U.S. PATENT DOCUMENTS 4,640,551 2/1987 Marten ..... 299/69 X

FOREIGN PATENT DOCUMENTS 2355232 5/1975 Fed. Rep. of Germany ..... 299/38
462868 11/1968 Switzerland ..... 404/90
1562377 5/1990 U.S.S.R. ..... 404/90

*Primary Examiner*—David J. Bagnell
*Attorney, Agent, or Firm*—Klaus J. Bach

[57] ABSTRACT

A method of making manholes and trenches in which the lateral edges of the manhole or trench are cut in a stepped manner. The apparatus for performing the procedure includes a trailer which is provided with a steerable drive wheel and carries a hydraulic pump motor unit adapted to operate a hydraulic motor driven circular saw and a hydraulically operated hammer both mounted on the trailer.

11 Claims, 4 Drawing Sheets

METHOD AND APPARATUS FOR MAKING MANHOLES

BACKGROUND OF THE INVENTION

1. Field of the Invention

The invention relates to a method of making manholes and trenches in hard top traffic areas, that is, traffic lanes for track free vehicles, such as streets and parking lots which have a substructure and a top structure which includes a support layer and a top layer of bituminous material or concrete and to an apparatus for performing the method.

2. Description of the Prior Art

In cities and also in small communities the utility lines for water and sewage, for electricity and gas as well as low voltage services (telephone and cable TV) are now generally disposed underground, that is, under the streets or beside the streets. Even newly paved streets and sidewalks must therefore be cut open if a breakdown occurs in any of the utility lines in order for such lines to be repaired. Generally it is sufficient to excavate a manhole, that is, essentially a square cavity of no more than 1 m side length. For water supply and drainage pipes however it is usually necessary to excavate a larger area. It is also often necessary to excavate a trench for the repair of the damaged lines or the reinstallation of such lines.

To cut an opening for such a manhole or trench an air hammer or a hydraulic hammer with a chisel blade is generally used to break an appropriately sized area out of the hard top surface and the underground is excavated in the usual manner with pick ax and shovel or with an excavating machine. After repair of the damage the hole is backfilled up to the support layer and is compacted and is then finally filled with a material which should correspond to the original surface layer material. Generally however the result is quite disappointing. For one reason the cutting of the top layer by an air hammer generates rugged edges for the manhole or the trenches and for another reason it is general experience that, in spite of the compaction of the underground fill material, the ground including the top structure still settles so that, depending on the traffic load, the area of the manhole or the trench forms, within a period of half a year or a year, a noticeable depression which can be eliminated only by additional backfilling. But even after backfilling repairs, the underground generally further settles so that, after a certain time, the same depression reoccurs. The reason for this is that the whole hard top surface generally distributes the load and the underground support or load carrying layers compensate for underground deformations. With later backfilling the original conditions for the top and support layers cannot be restored since the substructure, even after compaction, can move down or sidewardly whereas the backfilled top layer is not firmly joined to the original top layer and therefore glides slowly downward together with the pavement.

In order to avoid the ugly rugged edges of the cutouts for the repair openings, circular saws are sometimes utilized for cutting the hard top layer and partially even the support layer before the jack hammer is used along the saw cut line. However while this provides for a neater repair it cannot prevent the settling of the backfill material since no stable connection between the backfill and the original material layers is achieved.

Recently it has been proposed to excavate a manhole or a trench to the desired width by means of a jack hammer and/or an excavator and, after backfilling and compacting the substructure, to cut out the top layer and part of the support layer at a distance from the original hole or trench walls by means of a circular saw cut and to remove the cut off material. In this way a stepped area is formed between the compacted substructure and the remaining part of the support layer which can be filled with support layer material and finally with top layer material. Although these measures reduce the settling of the substructure and sharp clean joints are produced, the backfill support layer material is not interlocked with the original support layer material because of the smooth saw cut which again enhances settling of the backfill material. Also, because of the deep circular saw blade cuts, tooling costs are relatively high.

SUMMARY OF THE INVENTION

It is the object of the present invention to provide a method by which the disadvantages referred to above can be eliminated, that is, by which settling of the newly placed support and top layers can be eliminated.

This is achieved in accordance with the invention by cutting the top layer down to the support layer by means of a circular saw and then cutting the support layer at a distance of about 30 cm from the top layer cut toward the center of the manhole or trench, and finally the support structure , suitably again in stepped fashion by means of a hydraulic jack hammer with a chisel blade and to remove the cut material by an excavator, preferably a suction-type excavator.

The manholes and trenches made in accordance with the invention no longer have side walls which extend in planar fashion from the top to the bottom but steps are provided between the top layer and the support layer and possibly again between the support layer and the sub-structure. Such step arrangement permits that, after backfilling of the support layer onto the compacted sub-structure, a hard top layer can be placed down like a lid in such a manner that the hard top layer distributes a load thereon like the original structure so that a load is transmitted also to the original top layer. As a result the plastically deformable support layer is exposed to reduced load as it is designed for in normal traffic areas so that, provided the substructure is sufficiently compacted, the support layer and of course also the hard top layer will no longer settle. As a matter of fact practice has indeed shown that with careful backfilling of the various layers and sufficient compaction of the substructure, settling of the backfill of a manhole or trench has been avoided.

It should be taken into consideration that only the top layer is penetrated by the circular saw cut and that this is done initially so that already at the beginning of work, tensions in the top layer are eliminated. Consequently the top layer does not break off in an uncontrolled manner during further working with a hydraulic hammer such that the clean cut edges of the manholes or trenches remain undisturbed. This not only provides for good appearance of the backfilled and repaired manhole or trench but also permits problem-free placing of the top layer or insertion of a groove strip, etc.

It is particularly advantageous if, after cutting of the top layer, work is continued with a hydraulic jack hammer whose blade is placed onto the top layer at a distance from the cut of about the width of the hammer chisel blade. Hammer chisel blade operation generally provides for rough serrated separation wall surfaces which obtain additional projections when the ground is broken out between the particular hammer blade working areas. Particularly in connection with deep manholes or trenches it is advantageous to continue operation with an excavator, especially a suction excavator while again leaving a step of 5 cm to 30 cm whereby manhole or trench walls are obtained which interlock with the later backfilled ground or support material. Later settling of such layers is therefore essentially avoided.

The provision of appropriately stepped walls in accordance with the method according to the invention requires careful work which cannot always be expected in road construction environments. In accordance with the present invention there is therefore also an apparatus for performing the method which not only provides for the required step between the top layer and the support layer, but which substantially facilitates and accelerates the work procedures.

Such an apparatus in accordance with the present invention consists of a preferably single axle trailer which can be registered for road use and which has a tongue with a coupler provided with a motorized steerable drive wheel and which further has a circular saw with a hydraulic drive motor and a height-adjustable hydraulic hammer mounted on its side while carrying a motor operated hydraulic pump unit.

Mobile circular saws and drive motor units, though generally not admitted for street use, are known in the art. Those units are utilized as described above, that is, for cutting the top layer and, eventually, also a part of the support layer. Subsequently the cut-out is enlarged with the aid of pneumatic or hydraulic hammers wherein the chisel-like blades are inserted into the saw cut groove. In the arrangement according to the present invention the trailer is provided not only with a motor driven circular saw but also with a hydraulic hammer unit which is mounted at an adjustable distance from the circular saw unit such that the blade-like chisel thereof engages the top layer at such distance from the groove cut by the saw blade into the top layer. This produces a cover material portion delineated on one side by the groove and on the other side by the chisel area of the hydraulic jack hammer which portion can easily be removed by appropriately shaped lifting tools. Further operation is done in known manner with the hydraulic hammer or an excavator which cuts the support layers down to the substructure. The cut support layer materials are removed by an appropriate power tool. Further excavation of the manhole or the trench may then be performed in a suitable manner, for example, by a suction excavator which has not only the advantage that underground utility lines are not damaged but also that the procedure is quite fast and time saving.

The above referred to power tool may also be mounted on the trailer, for example, in such a manner that the hammer operating cylinder carries an arm with a gripper at its end which can engage and lift the separated top and support layer portions.

Of course the operation does not need to follow the order described above. It is possible for example to remove the top layer delineated by the saw cut after the saw cut is performed and then to separate the support layer by means of the jack hammer and also the substructure followed by the excavation of the separated materials.

No matter which procedure is preferred, work with the trailer according to the invention was found to be very practical and efficient since the trailer can be easily moved and guided in the right direction by means of the hydraulic motor operated drive which is mounted on the trailer tongue. This is important not only with regard to the formation of clean wall surfaces but also for careful treatment of the tools, particularly the circular saw blade. Guidance of the trailer is facilitated by the height adjustable support wheels mounted on the rear corners of the trailer which support wheels do not only take up the load from the travel wheels of the trailer but which also eliminate axle spring vibration transmissions to the tools. The support wheels may also be adjusted to different heights so that it is possible to operate, for example, at the edge of a sidewalk wherein one of the support wheels rolls on the street and the opposite support wheel rolls on the sidewalk.

In this manner the apparatus will not only permit to make sharp-edged manholes and trenches but it permits to complete the work in such a manner that there is almost no subsequent settling of the backfilled material.

BRIEF DESCRIPTION OF THE DRAWINGS

The drawings show schematically the procedure for the method according to the invention and also the apparatus, particularly.

DESCRIPTION OF THE PREFERRED EMBODIMENTS OF THE INVENTION

Figure 1:
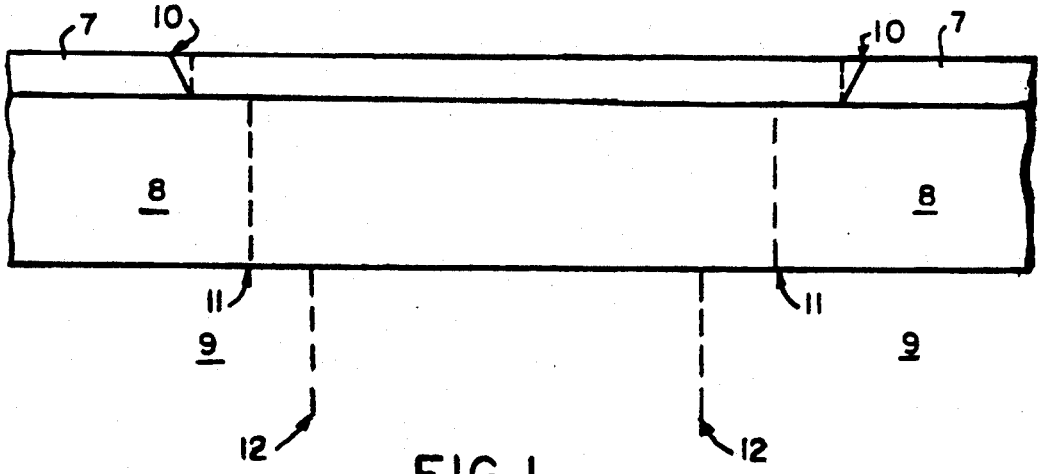
FIG. 1 shows a procedural scheme.
Figure 2:
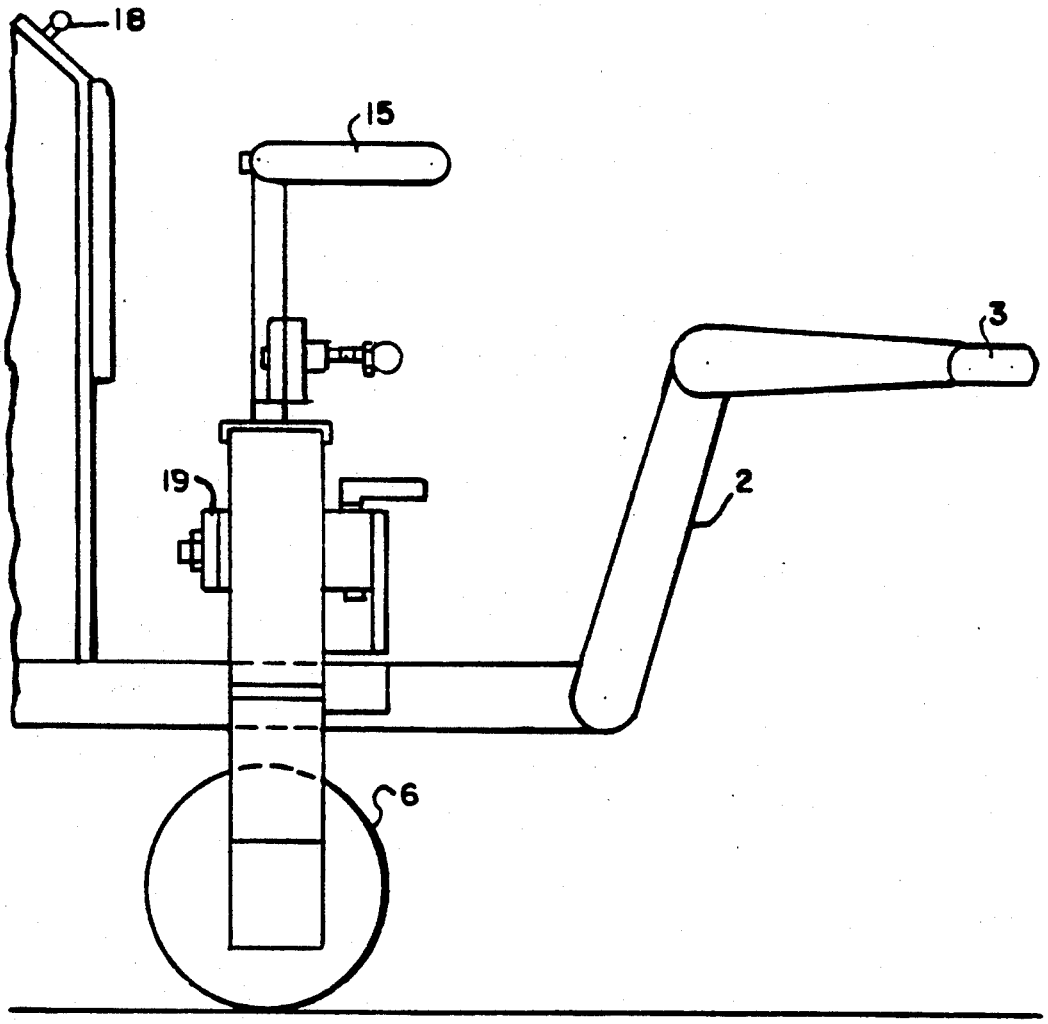
FIG. 2 shows the front, that is, the tongue portion of the apparatus.
Figure 3:
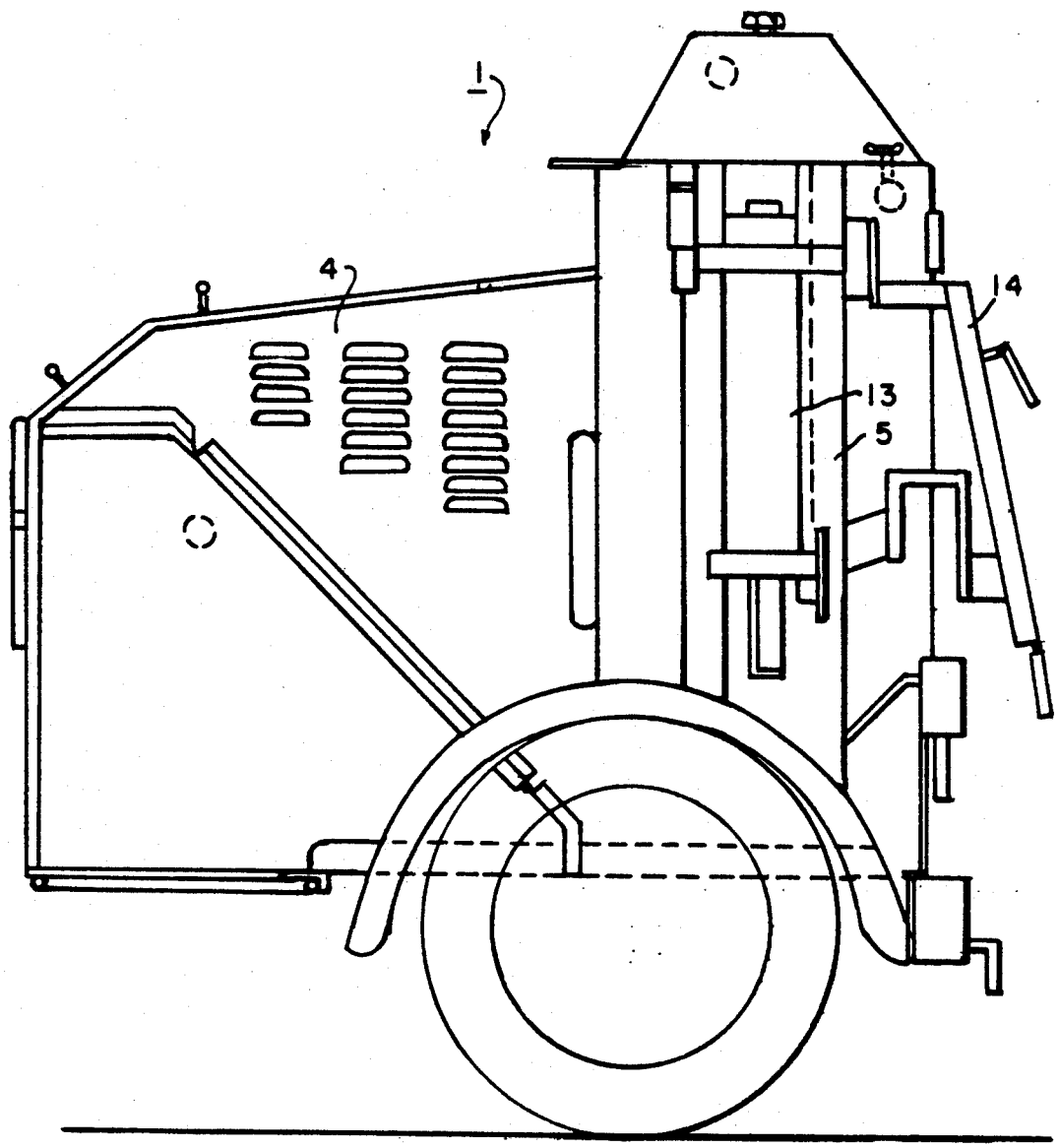
FIG. 3 is a side view of the trailer.
Figure 4:
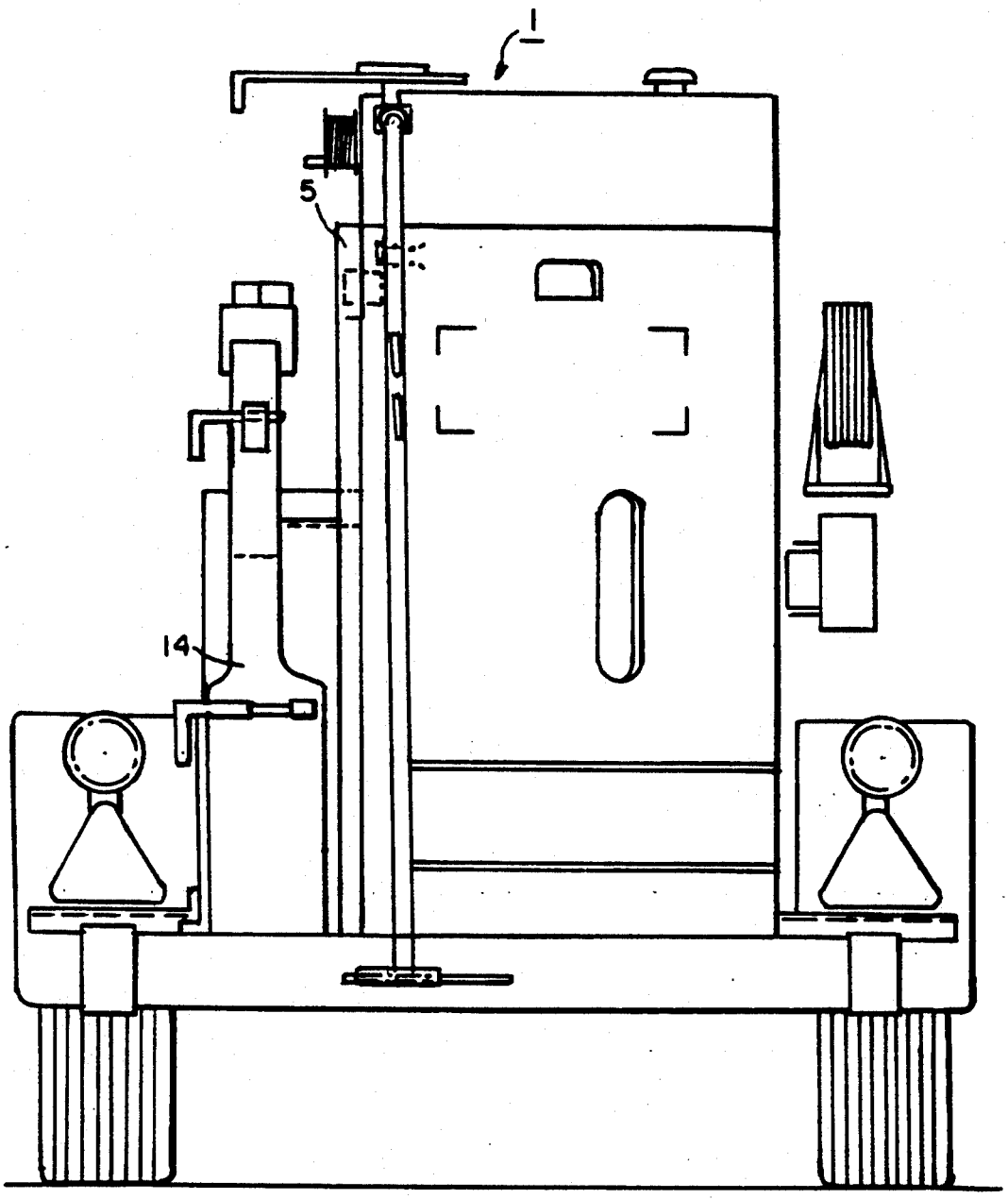
FIG. 4 is a rear view of the trailer.

FIG. 1 is a schematic view of the construction of a street wherein the numeral 7 indicates a street's top layer and 8 indicates a support layer disposed on top of a substructure 9. In accordance with the method of the invention the top layer 7 is cut at 10 by a saw blade vertically or at an angle of 20° with respect to the surface of the top layer 7 and is then lifted. Subsequently the support layer 8 is broken by a hydraulically operated blade along the dashed line 11 at a distance of up to 30 cm from the top layer cut and the broken support layer material is excavated. If the manhole or the trench is to be deeper, then the substructure is further excavated as indicated by the dashed lines 12 by means of an excavator, preferably a suction excavator. This procedure has the advantage that the top layer is cleanly cut by the circular saw cut 10 so that the manhole or trench will have straight, that is, clean edges which not only provide for good appearance but which also facilitate clean problem-free jointure of the backfill layers with the original top layer 7. The support layer 8 and the substructure 9 however have highly serrated or profiled walls providing for interlocking with the backfilled substructure and support layer material. In this manner settling of the backfill material is avoided if the backfill material is sufficiently compacted and level top layer can be obtained which remains level.

In order to perform the method shown schematically there is provided a single axle trailer 1 with a height-adjustable tongue 2 having a trailer coupler 3. The trailer 1 carries a hydraulic pump 4 coupled to a drive motor. Guide rails 5 are mounted on the side of the trailer 1 and an operating cylinder 13 is arranged between the rails 5. The guide rails 5 are adapted to guide a hydraulic hammer which is movable up and downwardly by way of the operating cylinder 13. The guide rails 5 further have a bracket 14 for supporting a circular saw with a saw blade mounted thereon in such a manner that the circular saw with the saw blade is also movable up and downwardly by the operating cylinder 13.

A drive wheel 6 operable by a hydraulic motor is mounted on the trailer tongue 2 by way of a pivot joint 19 and is steerable by a steerable by a steering lever 15. A control 18 for the hydraulic motor of the drive wheel 6 as well as for the hydraulic jack hammer and the circular saw motor is arranged at the front end of the trailer 1 near the steering lever 15.

Figure 5:
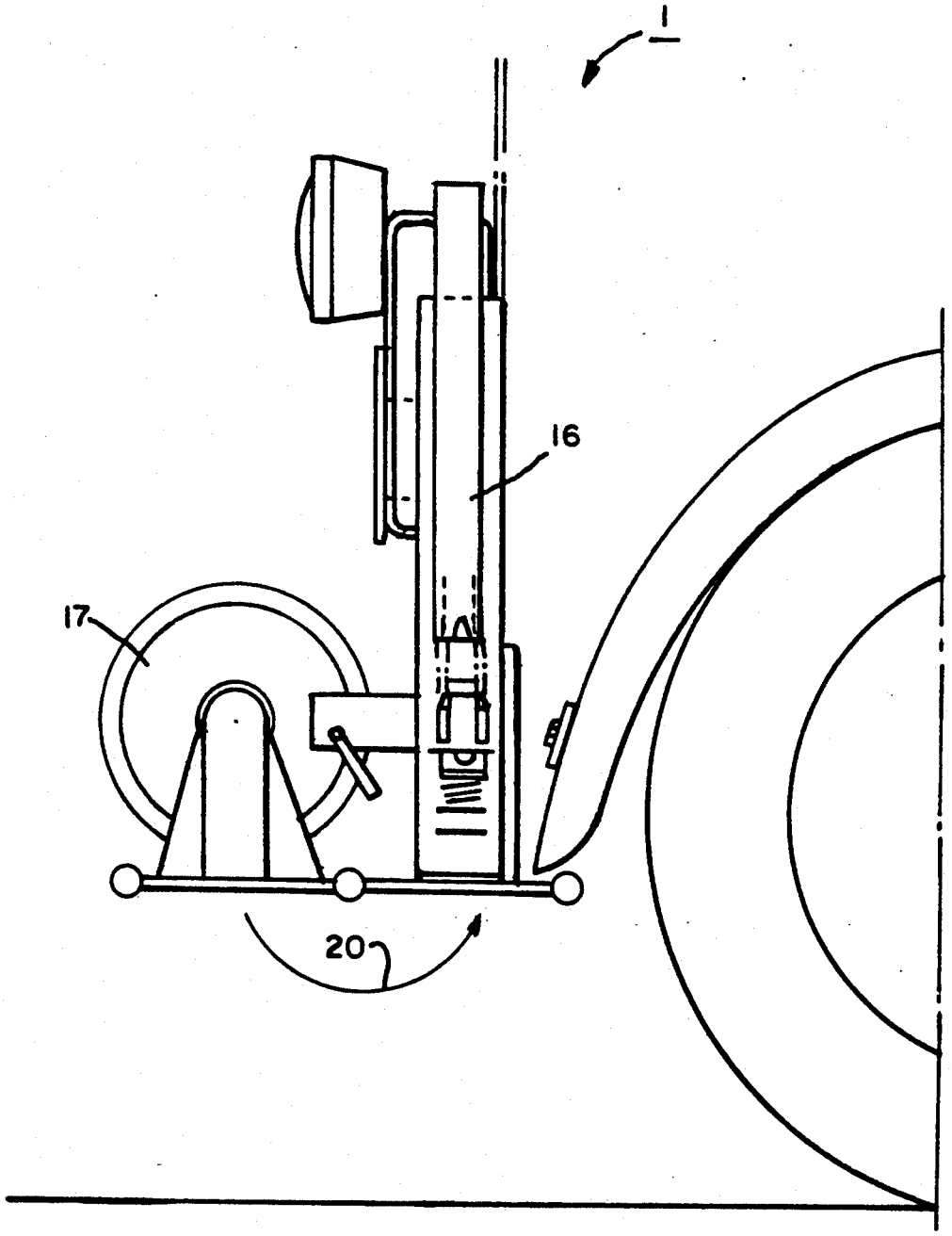
FIG. 5 shows the support wheel arrangement at a rear corner of the trailer.

A height adjustable support structure 16 for a support wheel 17 is mounted to each of the rear corners of the trailer 1. The arrangement is such that as indicated in FIG. 5 by arrow 20 the wheel can be pivoted downwardly into an operative position in which it is firmly adjacent the support structure 16. As indicated in FIG. 5 the support structure 16 includes a simple height adjustment mechanism for the support wheel 17, that is, a manually operable jack. It is of course possible to utilize a hydraulic jack since hydraulic pressure fluid is available anyhow.

The trailer 1 by way of its coupler 3 may be hitched to a corresponding hitch on a motor vehicle so that it can be transported easily and rapidly to a work location. At the work location, after start up of the hydraulic pump unit 4 and pivoting of the drive wheel 6 into the shown operating position, the trailer 1 is moved by way of the drive wheel 6 in such a manner that the saw blade, after its lowering by the hydraulic cylinder 13, is able to cut the top layer 7 maximally down to the support layer 8. Then the hydraulic hammer is utilized which, with its chisel blade, cuts the support layer 8 and possibly also the substructure in such a manner that a step of 5 to 30 cm remains adjacent the saw cut of the top layer. As a result a manhole or trench is produced in which the top layer 7 is cleanly and exactly cut along a given cutting line with the adjacent step extending laterally to the actual manhole or trench walls. After completion of the repair work in the manhole or trench, the manhole or trench is backfilled, the backfill is compacted and a new support layer 8 is provided and finally a top layer 7 is placed on top of the new and the exposed step of the original support layer.

What is claimed is:

1. In a method of making manholes and trenches in hard top traffic areas, which comprise a substructure and a top structure which top structure consists of a support layer disposed on a support structure and a final top layer of bituminous or concrete material, the improvement comprising the steps of cutting the top layer down to the support layer by means of a circular saw, then cutting the support layer at a distance of about 30 cm from the top layer saw cut toward the center of the manhole or trench and finally cutting the support structure suitably in stepped fashion by means of a hydraulic jack hammer with a chisel blade thereby generating cut material and removing the cut material by an excavator.

2. A method according to claim 1, wherein the circular saw cut is made at an angle of between 90° and 60° with respect to the top layer surface.

3. A method according to claim 1, wherein the hydraulic hammer chisel blade cuts are made at a distance of a chisel blade width from one another.

4. An apparatus for making manholes or trenches in hard top traffic areas, said apparatus comprising a trailer registrable for street use and having a trailer tongue with a motor vehicle coupler, said trailer tongue carrying a steerable drive wheel with a preferably hydraulic motor and said trailer having a circular saw with hydraulic drive motor mounted on one side thereof and with adjustable distance therefrom a hydraulic hammer with chisel blade which is supported height adjustably by a hydraulic operating cylinder, said trailer carrying a hydraulic pump with drive motor for supplying pressurized fluid to said hydraulic motors.

5. An apparatus according to claim 4, wherein said circular saw and said hammer are arranged near the rear end of the trailer opposite the trailer tongue.

6. An apparatus according to claim 4, wherein said circular saw is mounted on bracket which is pivotable between the angles of 90° and 60° with respect to the top layer surface.

7. An apparatus according to claim 4, wherein said circular saw is mounted, in operating direction, 10 to 30 cm in front of the hammer and slidably adjustably by 5 to 30 cm to the side of the hammer.

8. An apparatus according to claim 4, wherein said circular saw and said hammer are both mounted on a common operating cylinder.

9. An apparatus according to claim 4, wherein the hammer operating cylinder is provided with pivotal arm having a gripper for engaging cut top and support layer pieces.

10. An apparatus according to claim 4, wherein support wheels are mounted on the rear corners of the trailer by a height adjustable support structure, said wheels having a hinge support so as to be pivotal downward into operating position.

11. An apparatus according to claim 4, wherein the side wall of the trailer at its operating side is recessed inwardly such that the view of the work area from the trailer tongue remains unrestricted.

* * * * *